US005162013A

United States Patent [19]

von Mohr

[11] Patent Number: 5,162,013

[45] Date of Patent: Nov. 10, 1992

[54] TRANSFORMABLE TOY

[75] Inventor: Paul J. von Mohr, Monroe, Ohio

[73] Assignee: Mike Bowling Enterprises, Inc., Waynesville, Ohio

[21] Appl. No.: 717,623

[22] Filed: Jun. 19, 1991

[51] Int. Cl.[5] ..... A63H 3/00

[52] U.S. Cl. ..... 446/320; 446/183

[58] Field of Search ..... 446/177, 176, 309, 308, 446/311, 320, 183, 486, 220, 224, 226

[56] References Cited

U.S. PATENT DOCUMENTS 2,952,460 9/1960 Ellis ..... 446/177 X
2,968,121 1/1961 Pearson, Jr. et al. ..... 446/177
2,975,550 3/1961 Miller ..... 446/177
3,526,991 9/1970 Goldfarb et al. ..... 446/177
3,688,435 9/1972 Sapkus et al. ..... 446/320 X
3,900,638 8/1975 Du Bato ..... 446/220 X

*Primary Examiner*—Mickey Yu
*Attorney, Agent, or Firm*—Wood, Herron & Evans

[57] ABSTRACT

A transformable toy which can be converted to represent either of two different characters. A hollow upper part of the toy is collapsible on itself, by pushing down, to cover a lower part of the toy either partly or entirely and thereby hide features which are normally visible. The toy is held collapsed by restraining means and tends to return elastically to its uncollapsed configuration.

9 Claims, 3 Drawing Sheets

TRANSFORMABLE TOY

FIELD OF THE INVENTION

This invention relates to a toy which can be "transformed" or changed in appearance from one character to a second, quite different, character.

BACKGROUND

When the dress of a doll is changed, or when the attitudes of its arms, legs, and hands are changed, it takes on a superficially different appearance but the basic identity of the person or character represented by the doll remains the same.

Toys are known which can be changed from one character to a basically different character. Toys of this type are known as "transformable" toys. Schneider et al U.S. Pat. No. 4,614,505 shows a stuffed toy which can be transformed to create a different configuration. The transforming operation requires turning the toy inside out and stuffing the head into an elasticized pocket.

Ballow U.S. Pat. No. 4,576,585 shows a different way of transforming the appearance of a toy by evacuating the air inside a balloon-like face mask so that the mask wrinkles and collapses onto a configured inner head. Features of the inner head then translate through the collapsed mask and thereby give it a different appearance. A pump or source of vacuum is required to evacuate the mask.

Fanciful collapsible packing is known, in which a product such as liquid soap is dispersed by compressing a container shaped like a head to squirt soap out through an orifice.

SUMMARY OF INVENTION

It is the objective of this invention to provide a toy which can easily be transformed between different characters. In accordance with this invention, a toy is provided which has a hollow upper part that will fold and collapse when pushed downwardly, around at least a part of a lower portion, thereby covering and hiding features of the lower portion. The upper portion is hollow and folds around a circumferential line; features of the upper portion that are above the fold remain visible, but features of the upper portion below the fold, as well as features of the lower portion that are then covered, are no longer visible. A remarkable transformation of appearance occurs.

By way of example, the upper portion may be shaped like a dome or ball-shaped head, or a bell-shaped hat, and the lower portion may be the body of a character. When pushed down, the head folds along a line which runs around the head at the level of the mouth. The lower part of the head, below the fold, and at least part of the body are pushed up into that part of the head which is above the fold so that they are covered or "disappear." The head is molded and is hollow and resilient. It has a memory of its expanded (uncollapsed) configuration such that it tends to pop up again unless restrained from doing so. The head is held in the collapsed configuration or is permitted to expand only slowly, by restraining means. Various types of restraining (or retention) means can be used to hold the upper portion so collapsed onto the lower portion. For example, an internal plug or a snap having mating parts within the upper and lower portions, may be frictionally engaged or snapped to retain the head so collapsed on the body.

As another example, the head or upper portion may be held down by air pressure. When the head is pressed down, air in a cavity in the head is expelled through an outlet; readmission of air is restricted and the differential external pressure holds the upper portion downwardly until a valve is opened or air bleeds back in through a narrow orifice. The elastic "memory" of the molded head then expands it again.

The change which takes place upon collapsing the upper portion of this toy is more than a mere change of position or attire; the basic nature of the character changes.

It is advantageous that this toy is so easily convertible: the top is simply pushed down on the lower part. The configuration of the features which remain visible does not substantially change, but the covering or hiding of other features can drastically change the overall appearance. This simple movement can easily be accomplished by children; one part need not manually be stuffed into a pocket or evacuated with a pump.

In a preferred embodiment the upper portion or head is positioned on the neck of a body-like lower portion, which is relatively small in diameter in relation to the head. At least the head is hollow and is elastically deformable. Air can be expelled from within the hollow head through a narrow port, and outside pressure holds the head collapsed over the top part of the body. Air leaks back in slowly through the port, causing the head to "swell" and expand slowly again. The port may be closed by a valve or plug to hold the toy in collapsed configuration. The head may have various surface features molded and/or painted on it, such as a face, mouth, eyes, glasses, ears, various stylized haircuts, a helmet, and the like, which are visible at least in the normal (uncollapsed) configuration. At least some of the features of the body are covered by the head when it is collapsed over them, and what remains visible gives a very different appearance.

DESCRIPTION OF THE DRAWINGS

The invention can best be further described by reference to the accompanying drawings, in which.

FIG. 5 is a front elevation of the toy in expanded or normal position, FIG. 6 is a front elevation of the toy of FIG. 5 is collapsed position, and FIG. 7 is a vertical section through the toy of FIG. 6 in collapsed condition;

DETAILED DESCRIPTION

Figure 1:
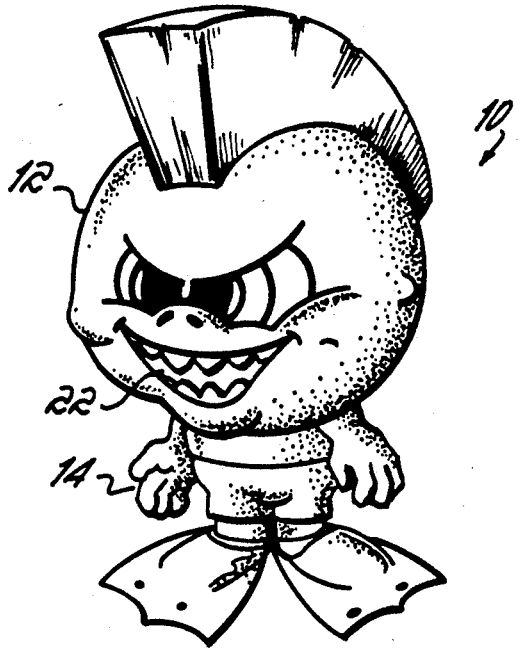
FIG. 1 is a perspective view of one form of transformable toy in its uncollapsed configuration, in which it represents a warrior.
Figure 3:
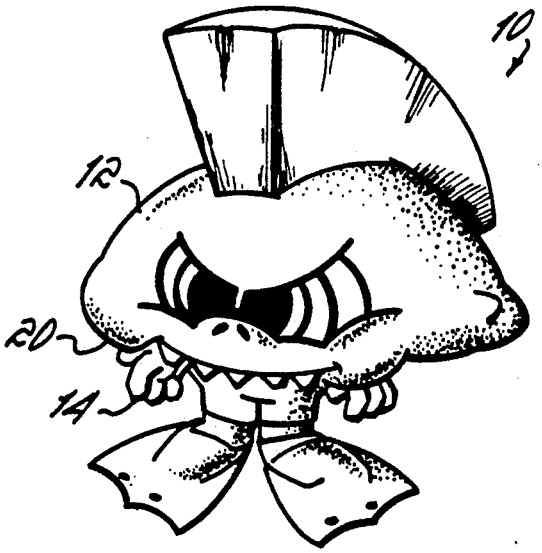
FIG. 3 shows the toy of FIGS. 1 and 2 in its collapsed configuration.
Figure 2:
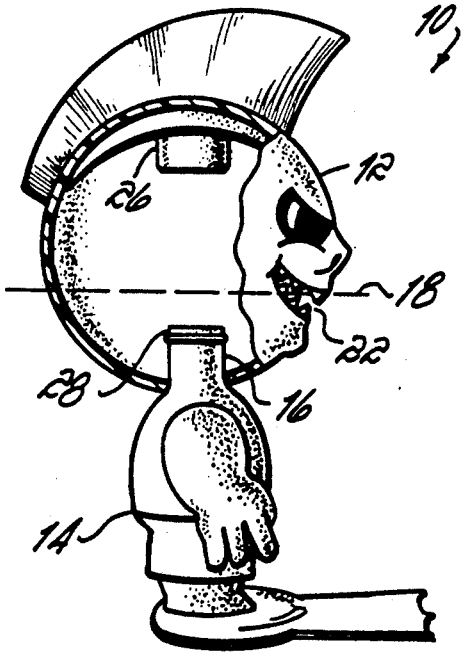
FIG. 2 is a side elevation, partly in section, taken on line 2—2 of FIG. 1.
Figure 4:
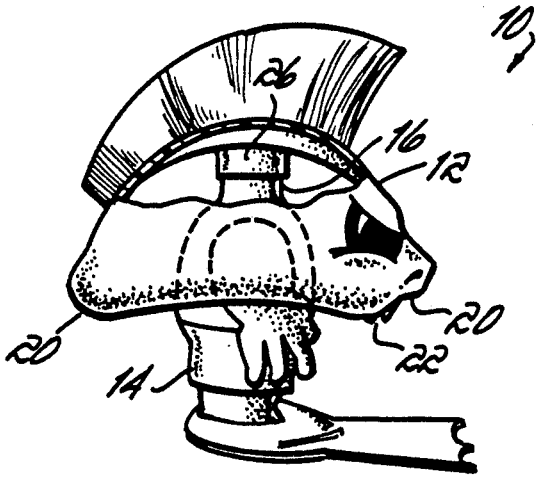
FIG. 4 is a side elevation, partly in section, taken on line 4—4 of FIG. 2.

The toy designated generally by 10 of FIGS. 1–4 is shown in its normal configuration in FIGS. 1 and 2, in which it represents a fanciful warlike character, and in its collapsed configuration in FIGS. 3 and 4, in which only its head and the lower half of its body are visible. This gives it a very different, gnome-like character.

Toy 10 has an upper or head portion 12 which is generally round or spherical, and a lower portion 14 comprising a body with shoulders, arms, hands, and feet. Preferably both the upper portion 12 and the lower body portion 14 are molded separately as by rotary molding, and then are assembled. The head is hollow, preferably of flexible vinyl, since it must fold to collapse. The lower portion 14 need not be so flexible, since it is not necessarily required to fold. The lower part 14 includes a neck or stem 16 which projects upwardly through an opening at the bottom of the head 12, and onto which the head is secured by a press-on fit and/or with adhesive.

The head can be collapsed to cover at least the upper part of the body, as shown in FIGS. 3 and 4. When the upper portion 12 is collapsed downwardly, as by pushing down with one's hand, it folds around a peripheral or circumferential fold line indicated generally by the dotted line 18 in FIG. 2. Folding along line 18 may be promoted by an opening such as mouth area 22 along the line, and/or the head may have a relatively thin wall along the line. That part of the head which is below fold line 18 inverts or folds upwardly into the interior of the top part of the head above the fold line. The collapsed head may bulge slightly outwardly around line 18, as designated at 20 in FIG. 4, imparting a bell-shape to the part of the head above line 18, as shown in FIGS. 3 and 4.

Restraining means is provided to hold upper portion in collapsed position with respect to the lower portion. The restraining means may take various forms. In the embodiment of FIGS. 1–4 the restraining means comprises an interconnectable friction plug 26, 28. Plug half 26 is a downwardly opening cup positioned on the inside of the head at the top, while the other plug half 28 is an upstanding post inside the head at the top of the neck 16 of the body. These are preferably molded integrally on the respective portions 12, 14. Upper plug half 26 interfits frictionally with the lower half 28 when they are brought together, to hold the head collapsed.

Since the head is molded in the "up" position shown in FIGS. 1 and 2, it has a memory of that as its normal configuration and tends to return elastically to that position when collapsed from it. If not retained by plug 26, 28, the head would not remain in the collapsed position. The mating parts 26, 28 of the restraining means are aligned and positioned to interconnect when the head is pushed downwardly over the body. They are released by pushing upwardly along the fold line 18.

Figure 5:
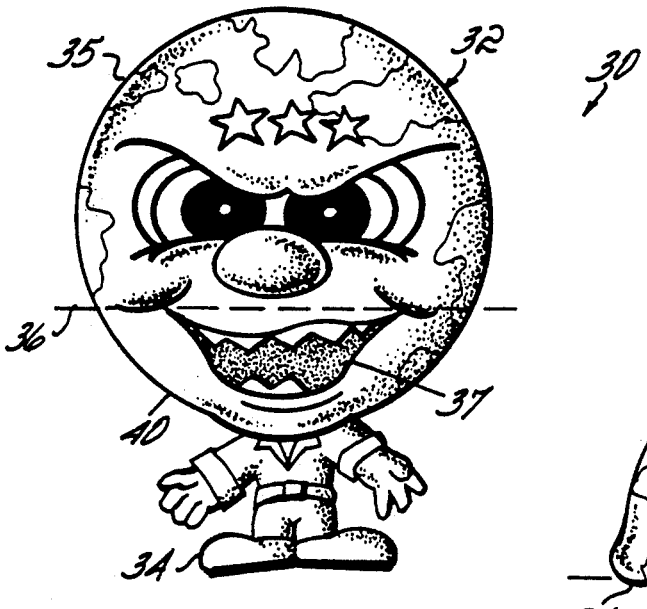
FIGS. 5, 6 and 7 illustrate a second embodiment of the invention. More specifically.
Figure 6:
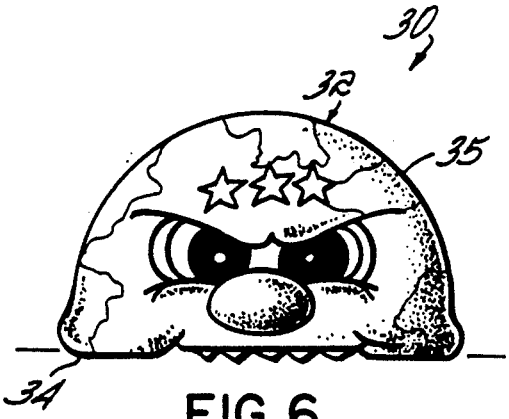
Figure 7:
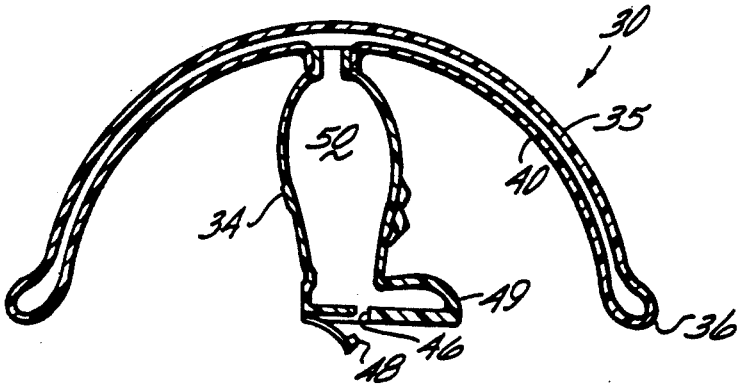

By appropriate design the head can cover virtually the entire body, so that the toy resembles a mushroom-like character. Features on the lower portion which are visible in normal configuration are virtually concealed and covered in the collapsed position. Such an embodiment is shown in FIGS. 5–7. The toy 30 shown there differs from toy 10 in that its upper or head portion 32 collapses to cover the entire lower or body portion 34 (FIGS. 6 and 7). The head folds around a fold or hinge line 36 which runs circumferentially around it, at about the level of the top of the mouth 37. Thus in the collapsed configuration only the top half 35 of the head, above the mouth, is normally visible. The lower half 40 of the head, below fold line 36, inverts within the top half (see FIG. 7).

It should be noted that in this embodiment the folding which takes place is an inversion or folding of the head, while the body itself does not fold. In other embodiments the body can also or alternatively collapse.

Instead of using a mechanical connection, the body may alternatively be restrained in the collapsed condition by external air pressure, as shown in FIG. 7. For this purpose an outlet port 46 is provided in a concealed or less visible area of the toy such as the foot 49, and a manually operable plug or poppet 48 is insertable in port 46 to close it. When the head is pushed downwardly, air in the internal chamber 50 of the toy escapes through open port 46. (The pressure of air in chamber 50 when compressed by downward force on the head can itself open the port to escape, or a check valve can be provided.) Air is thereby expelled from the space 50. The plug 48 is inserted in the port 46 when the head has been collapsed, so that the chamber cannot refill with air even though the memory of the molding tends to reexpand the head. Thus the differential external air pressure holds the toy in collapsed condition.

Figure 8:
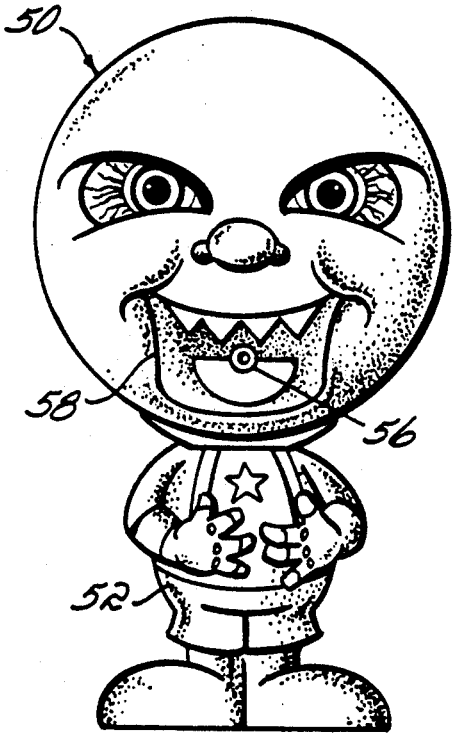
FIG. 8 is a front elevation of a third embodiment of the invention, in its normal configuration.
Figure 9:
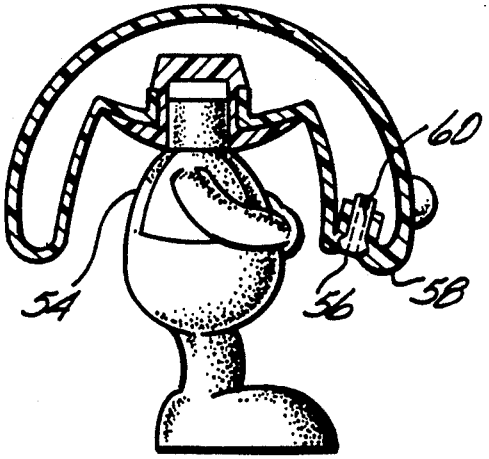
FIG. 9 is a cross sectional view of the toy of FIG. 8 in collapsed configuration.

FIG. 8 shows the presently preferred embodiment of the invention, in which a hollow, generally spherical rotationally molded head 50 is press-fitted onto an injection molded solid body 52. The head is collapsed to cover the upper part 54 of the body by pushing down on it to expel air through a small restricted orifice 56 which is located in the mouth 50 of the head. The restricted orifice may have a reed or vibrator 60 which emits a whistling or sighing sound as air is expelled from the head. In this embodiment the orifice is not closed but slowly readmits air into the head, which gradually reexpands itself to normal configuration; the restraining means does not permanently hold the head down, but causes it to reinflate slowly, for example over a period of 5–15 seconds, so that it gradually "grows" from the collapsed configuration to the normal configuration. The head has a heavier wall thickness around the mouth (see FIG. 9) as a result of which it expands and lifts first in the back where the wall is thinner, then in front. This is manifested as a forward nodding or downward tilting of the head, then a more sudden uplift of the face area.

Apart from the frictional plug and valve means shown in the drawings, those skilled in that art will appreciate that it is feasible and practical to use other restraining means including but not limited to mechanical snaps, "Velcro" type attachments, and so on.

Having described the invention, what is claimed is:

1. A toy transformable between a normal configuration in which it represents one character and a stable collapsed configuration in which it represents a second, different character, said toy comprising, a hollow, molded upper portion and a lower portion, each said portion displaying features on its surface, both said portions being seen when said toy is in said normal configuration and creating a representation of said one character, said upper portion being collapsible downwardly toward and over said lower portion, to said collapsed configuration, so as to hide at least some of the features of said lower portion from view, surface features of said portions which are not hidden and which remain visible creating a representation of said second character, said upper portion tending elastically to return from said collapsed configuration to said normal configuration, restraining means preventing movement of said upper portion from said collapsed configuration to said normal configuration, said restraining means being selectively interfittable when said toy is in said collapsed configuration to prevent said toy from returning from said collapsed position to the normal configuration, said toy being collapsible when moving from said normal configuration to said collapsed configuration, about a fold line that extends circumferentially around said upper portion, a part of said upper portion lying below said fold line inverting upwardly into a part of said upper portion above said fold line when being so collapsed, and said upper portion including a mouth and said fold line extends around said upper portion at said mouth.

2. A toy transformable between a normal configuration in which it represents one character and a stable collapsed configuration in which it represents a second, different character, said toy comprising, a hollow, molded upper portion and a lower portion, each said portion displaying features on its surface, both said portions being seen when said toy is in said normal configuration and creating a representation of said one character, said upper portion being collapsible downwardly toward and over said lower portion, to said collapsed configuration, so as to hide at least some of the features of said lower portion from view, surface features of said portions which are not hidden and which remain visible creating a representation of said second character, said upper portion tending elastically to return from said collapsed configuration to said normal configuration, restraining means preventing movement of said upper portion from said collapsed configuration to said normal configuration, said restraining means being selectively interfittable when said toy is in said collapsed configuration to prevent said toy from returning from said collapsed position to the normal configuration, and said restraining means comprising interconnectable mating portions located internally of said toy.

3. The toy of claim 1 or claim 2 wherein said upper portion is a head and said lower portion is a body.

4. The toy of claim 1 or claim 2 wherein in said collapsed configuration said upper portion covers only a part of said lower portion.

5. The toy of claim 1 or claim 2 wherein in said collapsed configuration said upper portion covers substantially all of said lower portion.

6. The toy of claim 1 or claim 2 wherein said upper portion is of flexible vinyl.

7. The toy of claim 1 or claim 2 wherein both said upper and lower portions are hollow.

8. The toy of claim 1 or claim 2 wherein both said upper and lower portions are molded.

9. The toy of claim 1 or claim 2 wherein said upper portion is rotationally molded and is affixed to said lower portion.

* * * * *